US006419650B1

(12) United States Patent
Ryan et al.

(10) Patent No.: US 6,419,650 B1
(45) Date of Patent: Jul. 16, 2002

(54) DEVICE FOR PROVIDING ACCUPRESSURE BACK MASSAGE

(75) Inventors: James P Ryan, Cazenovia; John Cummings, Rochester; John O'Connor, Clay, all of NY (US)

(73) Assignee: Fitness Works INC, Calenovia, NY (US)

( * ) Notice: Subject to any disclaimer, the term of this patent is extended or adjusted under 35 U.S.C. 154(b) by 0 days.

(21) Appl. No.: 09/453,211

(22) Filed: Dec. 3, 1999

(51) Int. Cl.[7] ..... A61H 15/00
(52) U.S. Cl. ..... 601/122; 601/19
(58) Field of Search ..... 601/19, 20, 72, 601/32, 118–122, 125, 128, 131, 123, 126, 127, 129–130; D24/200, 211, 212, 214; 446/469, 466

(56) References Cited

U.S. PATENT DOCUMENTS

| | | | | | |
|---|---|---|---|---|---|
| 1,630,149 | A | * | 5/1927 | Wahrt | |
| 2,072,959 | A | * | 3/1937 | Mulvaney et al. | 128/57 |
| 2,787,261 | A | * | 4/1957 | McDonald et al. | 128/24.3 |
| 3,645,256 | A | * | 2/1972 | Morrison | 128/57 |
| D228,967 | S | * | 10/1973 | Holladay | D24/99 |
| 4,002,163 | A | * | 1/1977 | Jackson, Jr. | 128/57 |
| 4,067,324 | A | * | 1/1978 | Greenawalt | 128/57 |
| 4,267,610 | A | * | 5/1981 | Blakeway et al. | 5/60 |
| 4,518,162 | A | * | 5/1985 | Oates | 272/93 |
| 4,577,858 | A | * | 3/1986 | Higami | 272/67 |
| 4,688,556 | A | * | 8/1987 | Keller, Jr. | 128/57 |
| 4,832,006 | A | * | 5/1989 | Kirsch | 128/57 |
| 5,352,188 | A | * | 10/1994 | Vitko | 601/128 |
| 5,588,953 | A | * | 12/1996 | Chang | 601/124 |
| 5,772,614 | A | * | 6/1998 | Lindquist | 601/116 |

FOREIGN PATENT DOCUMENTS

| | | | | |
|---|---|---|---|---|
| GB | 2 230 706 | A | * 10/1990 | 601/122 |

* cited by examiner

*Primary Examiner*—Denise M. Pothier
(74) *Attorney, Agent, or Firm*—Sherman & Shalloway

(57) ABSTRACT

A device for providing back massage with simultaneous accupressure stimulation along either side of the spine. The device comprises a frame in which are disposed a plurality of rollers which are freely rotatable and capable of being interchangeably positioned within the frame. One roller is of a larger diameter than the remaining rollers and is provided with a central circumferential groove which is bounded on each side by a surface having a plurality of nubs. In use, the nubs contact the user's body on either side of the spine at the desired location to provide accupressure stimulation. By providing the accupressure stimulation roller in a diameter which is larger than the other rollers, the device also provides intervertebral or intersegmental extension during use.

8 Claims, 4 Drawing Sheets

DEVICE FOR PROVIDING ACCUPRESSURE BACK MASSAGE

FIELD OF THE INVENTION

The invention relates to a device for providing back massage with simultaneous accupressure stimulation along either side of the spine. The device comprises a frame in which are disposed a plurality of rollers which are freely rotatable and capable of being interchangeably positioned within the frame. One roller is of a larger diameter than the remaining rollers and is provided with a central circumferential groove which is bounded on each side by a surface having a plurality of nubs. In use, the nubs contact the user's body on either side of the spine at the desired location to provide accupressure stimulation. By providing the accupressure stimulation roller in a diameter which is larger than the other rollers, the device also provides intervertebral or intersegmental extension during use.

BACKGROUND OF THE INVENTION

Within the field of massage and physical therapy, it has long been recognized that massage, accupressure stimulation, and intervertebral extension have great benefits in treating various back and neck related ailments. However, such treatments often require many visits to a massage or physical therapist or the use of highly specialized, complex and expensive equipment. As a result, patients are often reluctant to pursue or continue the treatment regimens necessary to alleviate such ailments.

Intervertebral or intersegmental extension involves the slight mobilization and gliding of one vertebra relative to the adjacent vertebrae in the spine. Accupressure stimulation is a therapeutic intervention whereby certain points are stimulated by gentle but firm pressure to provide muscular relaxation and pain relief.

Many devices have been proposed for back stimulation and treatment with varied levels of success. Many, such as Bushmiller, U.S. Pat. No. 1,593,014, Matheson, U.S. Pat. No. 1,836,981, Blakeway, et al., U.S. Pat. No. 4,267,610, Vitko, U.S. Pat. No. 5,352,188, and Lindquist, U.S. Pat. No. 5,772,614, comprise generally large and/or complex apparatus which have limited versatility and adjustability with respect to providing the desired stimulation and extension to selected locations along the spine. In particular, while it is noted that both Vitko and Lindquist include a larger size roller, or balls in the case of Vitko, these elements are restricted to a location at the user's neck and shoulders, with no provision for changing their locations so as to provide an increased degree of vertebral extension anywhere else along the spine. In addition, the size of such devices, i.e., similar to that of a standard bed, renders them expensive and difficult to store when not in use. Other devices, such as Ferguson, U.S. Pat. No. 4,142,519, Fujiwara, U.S. Pat. No. 4,205,663, McKay, U.S. Pat. No. 5,558,625 and Walker, et al., U.S. Pat. No. 5,577,995, are limited in use to particular physical areas, such as the soles of the feet, as in the case of Walker and McKay, or require a second person or unusual contortions on the part of the user to operate. Still other devices, although intended specifically for use in providing back massage, are deficient in the degree of support provided across the back while massaging the area immediately adjacent to the spine, or are limited in the number and/or position of the massaging elements. For example, Hamilton, U.S. Pat. No. 1,572,794, Conrad, U.S. Pat. No. 2,377,131, Hague, U.S. Pat. No. 2,619,957, Everett, et al., U.S. Pat. No. 4,193,394, Keller, Jr., U.S. Pat. No. 4,688,556, and Kirsch, U.S. Pat. No. 4,832,006.

The present invention successfully combines the desired features of variable massage and accupressure stimulation with intervertebral extension in a compact and portable device which is easily stored when not in use but can be quickly set up by a patient thereby promoting its use and the patient's compliance with his therapists suggested exercises. In addition, the relative location of the massaging elements or rollers is completely variable thereby permitting one to obtain massage, intervertebral extension and accupressure stimulation at any point along the spine where such treatment is needed simply by changing the relative position of the rollers.

SUMMARY OF THE INVENTION

It is an object of the present invention to provide a device for back massage and accupressure stimulation which is simple to operate and easy to use.

It is a further object of this invention to provide a device for back massage and accupressure stimulation which affords complete interchangability of massaging and stimulating elements.

It is a still further object to provide a device which does not require disassembly in order to change the massaging and stimulation elements.

Further objects and advantages will become evident from the accompanying description and claims.

The present invention provides a combination back massage and accupressure stimulation apparatus comprising a rectangular frame and a plurality of rollers receivable within the frame and freely rotatable therein, the rollers having a diameter greater than a height dimension of the frame whereby the rollers extend above and below the frame to support a user lying supine thereon and whereby the frame includes means to maintain the plurality of rollers in a spaced, parallel and freely rotatable operating arrangement, this means further allowing the rollers to be readily interchangeable.

Further, the present invention provides a combination back massager and accupressure stimulation apparatus comprising, a) a rectangular frame comprising first and second elongated rails joined in parallel and spaced relationship by first and second cross bars defining an area capable of receiving and retaining a plurality of rollers therein, and b) a plurality of rollers receivable within the frame, the rollers each comprising a cylindrical roller body having centrally located spindles on each end thereof, wherein rails are provided with means to removably receive the spindles whereby the rollers are receivable within the frame in a spaced parallel arrangement and are freely rotatable and interchangeable within the frame.

In addition, the invention provides at least one roller of a larger diameter which is freely interchangeable with any or all of the other rollers and which provides intervertebral or intersegmental mobilization and extension. In an alternative embodiment, this larger roller is provided with accupressure stimulation means on the surface to provide stimulation of paravertebral acupuncture points along the user's spine.

DETAILED DESCRIPTION OF THE INVENTION

Figure 1:
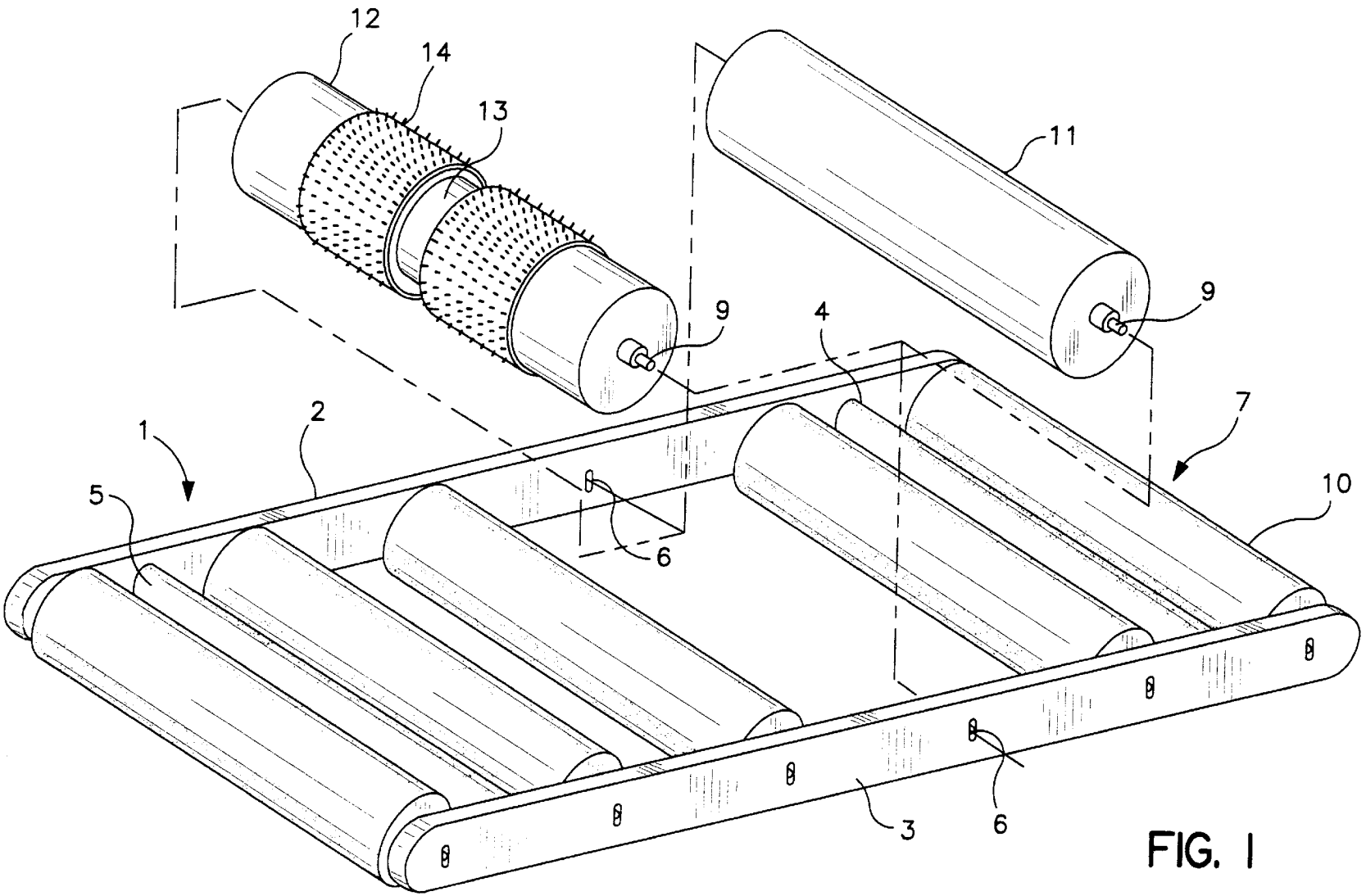
FIG. 1, is an oblique view of a principal embodiment of the invention showing the interchangability of the rollers.

As shown in FIG. 1, the massage device comprises an elongated frame 1 having a length to extend substantially from the first cervical vertebra to the coccyx of a user and comprises first and second side rails 2 and 3, which are joined in a spaced and parallel relationship by first and second cross bars 4 and 5 attached to side rails 2 and 3. Side rails 2 and 3 have a height of from 2 to 3 inches, while the cross bars 4 and 5 are of a height which is preferably less than that of the side rails 2 and 3 and a length sufficient to provide the frame 1 with a width substantially equivalent to that of the lumbar region of the human back. Spaced substantially equidistantly along the side rails 2 and 3 and extending into or through the thickness of the side rails 2 and 3 are a plurality of slots or grooves 6 which are substantially perpendicular to the longitudinal axis of the side rails 2 and 3 and which receive the spindles 9 of a plurality of massage rollers 7 and accessory rollers 11 and 12. Preferably the frame 1 has slots or grooves 6 to receive at least six rollers at a time, although more or fewer than six rollers may be used either by lengthening or shortening the frame 1 or by adding or removing rollers as desired.

The rollers 7, 11 and 12, comprise a roller body 8 of cylindrical configuration with a spindle 9 at each end. In the case of massage rollers 7, the roller body 8 is covered with a sleeve of resilient foam 10 or similar material. Alternatively, massage rollers 7 may be made from a material which has a density sufficient to provide both physical strength and support as well as a comfortable resilient surface. The diameter of rollers 7 is greater than the height of the frame 1 such that the rollers 7 provide both support and massage for the user. Preferably, the diameter of rollers 7 is from 4 to 5 inches. The frame 1 provides a means to retain the rollers 7 in operating relationship while permitting them to be freely added, removed or interchanged. Preferably, the frame 1 does not serve as a support device for the user, rather this function is taken by the rollers engaging a planar support surface such as a floor, a platform, or the like.

In addition to massage rollers 7, the device comprises an intervertebral extension roller 11 which has a length dimension equal to that of the massage rollers 7, but a diameter which is greater. Like massage rollers 7, intervertebral extension roller 11 is provided with spindles 9 centrally disposed at each end to mount roller 11 in the slots 6 of frame 1. To provide the desired degree of intervertebral extension, roller 11 has a diameter which is at least ⅛ greater than that of massage rollers 7. Preferably, intervertebral extension roller 11 has a diameter which is from ¼ to ½ greater than that of massage rollers 7. In addition, intervertebral extension roller 11 has a density which is at least the same as massage rollers 7 and is preferably greater while retaining sufficient resiliency to avoid discomfort or damage to the spinous processes of the vertebrae and is freely interchangeable with any or all of massage rollers 7 to provide the user with intervertebral extension anywhere along the spine.

The construction of massage rollers 7 and intervertebral extension roller 11 preferably comprises a substantially rigid core of wood, plastic or dense rubber with an outer covering of resilient foam 10 or other material.

As an alternative to the intervertebral extension roller 11, the massage device also comprises a combination intervertebral extension and accupressure stimulation roller 12 which provides intervertebral extension and includes means to provide accupressure stimulation to acupuncture points along either side of the user's spine. Combined intervertebral extension and accupressure stimulation roller 12 has a length dimension equal to massage rollers 7 and an overall diameter substantially the same as that of intervertebral extension roller 11. Unlike rollers 7 and 11, combined roller 12 is substantially rigid without a resilient foam covering . To accommodate the spinous processes of the user's vertebrae, combined roller 12 is provided with a circumferential groove or channel 13 encircling roller 12 about the longitudinal mid-point. The depth of groove 13 is sufficient to permit vertebral spinous processes to pass roller 12 without contacting the body of roller 12.

Figure 2:
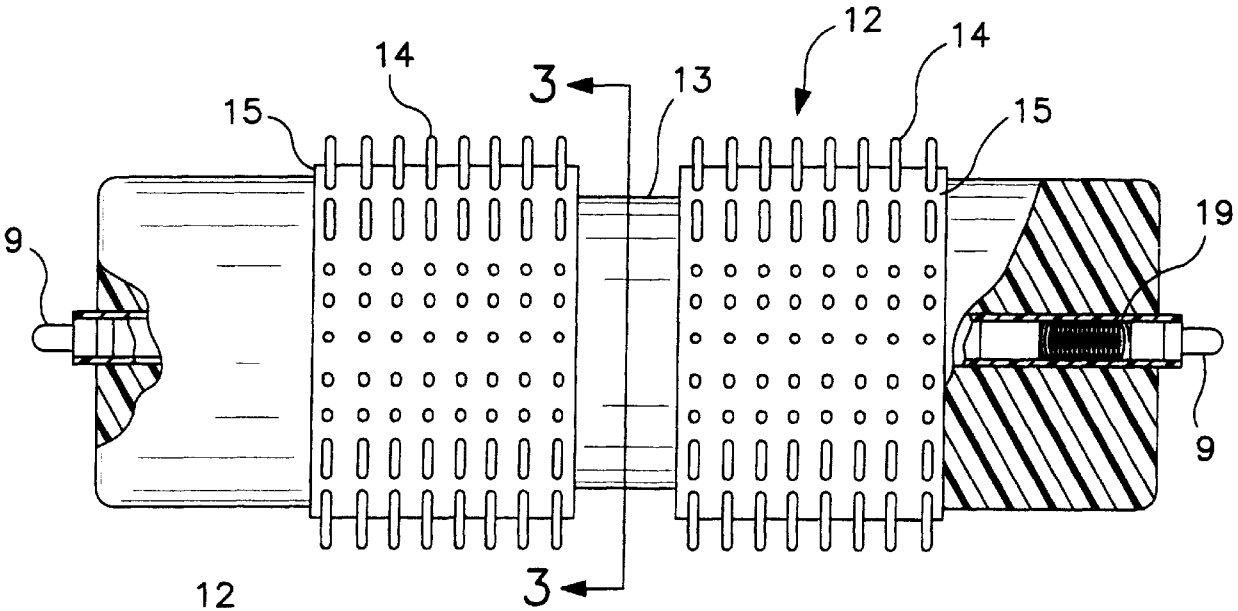
FIG. 2, is a detailed view of the intervertebral extension and accupressure stimulation roller of the invention.
Figure 4:
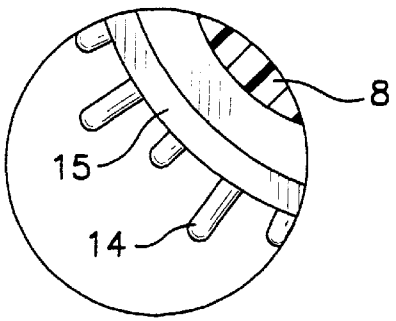
FIG. 4 is a detailed view of the accupressure stimulation nubs of the roller of FIG. 2.
Figure 3:
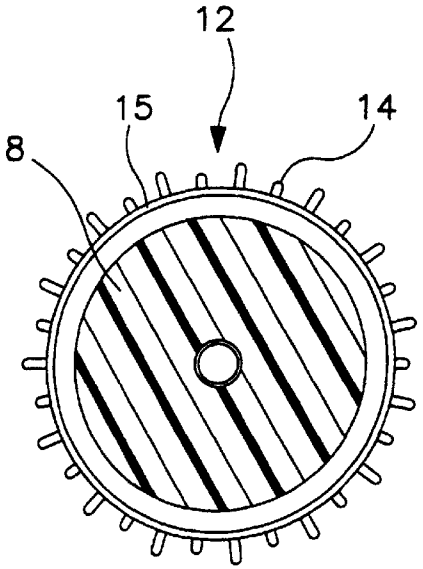
FIG. 3 is a cross section of the roller of FIG. 2 taken along line 3—3 of FIG. 2.

Located on the surface of roller 12 to either side of groove 13, are a plurality of projections or nubs 14 arranged in a pattern which encircles the outer surface of roller 12. Where roller 12 is molded from a dense material, such as hard rubber or plastic polymers, nubs 14 are preferably formed as an integral part of roller 12 from the same material. Alternatively, and preferably, roller 12 and nubs 14 are separate elements with nubs 14 being part of a band 15 which is capable of being slid onto and off of roller 12. Such an arrangement is shown in FIGS. 2–4.

Band 15 is preferably of a diameter so as to be capable of being slid onto roller 12 from one end to a position adjacent to circumferential groove 13. At least two bands 15 are provided, one for each side of roller 12 adjacent to groove 13. In that position, nubs 14 are located so as to massage and stimulate the paravertebral acupuncture points which are located bilaterally to the vertebral column along longitudinal acupuncture meridians that extend from the occiput to the sacrum. In order to obtain proper stimulation, it is desired that the bands 15 be stationary on roller 12 and that there be no relative motion between the bands 15 and roller 12 while the user is on the device. To that end, bands 15 are preferably made of a material which is capable of being stretched and which has a resting diameter which is slightly less than the diameter of roller 12. Bands 15 are stretched to permit them to pass over roller 12 and, when released, grip roller 12 tightly so as to resist displacement. The inner surface of bands 15 is preferably roughened to form a friction surface to facilitate this gripping action.

Figure 7:
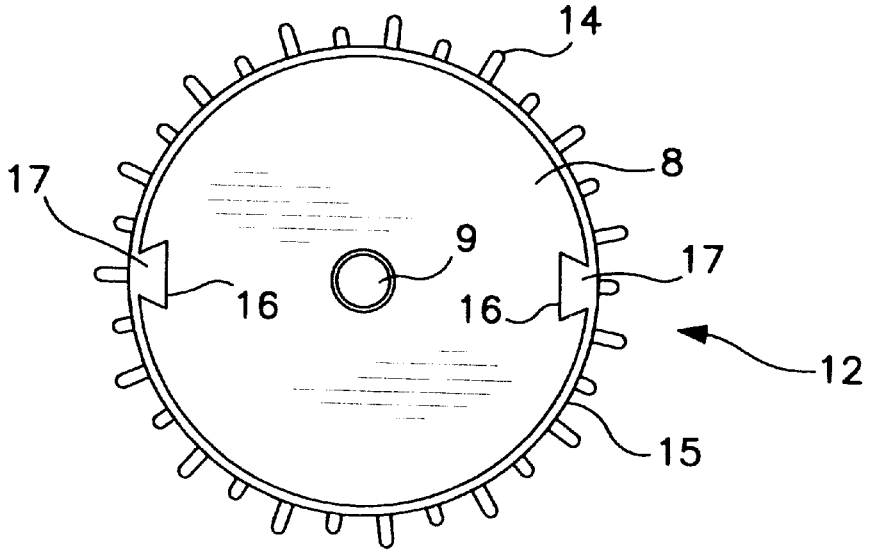
FIG. 7 is an end view of the intervertebral extension and accupressure stimulation roller of FIG. 2 showing a means for preventing free rotation of the stimulation nub band.

In an alternative embodiment, shown in FIG. 7, the body of roller 12 is provided with longitudinal slots or keyways 16 and the inner surface of bands 15 are provided with a corresponding key 17. When said band 15 is slid onto roller 12, the keys 17 on the band 15 engage the slots to provide retention of the bands.

Figure 8:
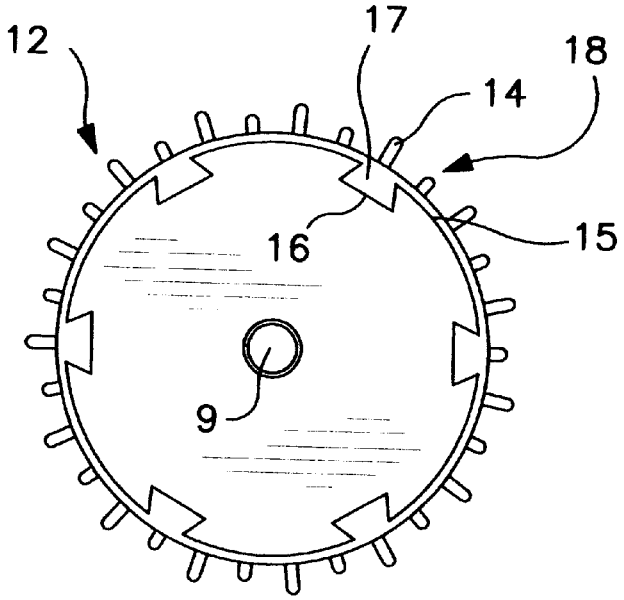
FIG. 8 is an end view of an alternative embodiment of the intervertebral extension and accupressure stimulation roller of FIG. 2.

In a still further embodiment shown in FIG. 8, nubs 14 are provided on a plurality of strips 18 with each strip 18 forming an arc corresponding to a portion of the circumferential surface of roller 12. Each strip 18 is molded with a key 17. Combination roller 12 has a plurality of corresponding slots 16 about its circumference to receive the keys 17 of strips 18 such that when all strips 18 are installed, the surface of roller 12 is circumferentially covered with accupressure nubs 14.

The nubs 14 may be formed in a variety of shapes, sizes and patterns including, but not limited to, cylinders, cones, pyramids, cross or X-shapes, and in linear, concentric, or spiral rows or random patterns. In a preferred arrangement, the nubs 14 are formed in rows of alternating tall and short nubs, as shown in the following chart where X=tall nubs and O=short nubs:

xoxoxox oxoxoxo xoxoxox oxoxoxo

Although this is a preferred arrangement for the nubs, other arrangements are possible and within the scope of this invention. The rows are arrayed along the longitudinal axis of the roller 12 as shown in FIG. 2. The spacing between the rows and between the nubs in each row may vary but is preferably between ¼" and ⅜" which is a spacing which has been found to provide optimum massage and stimulation. Similarly the height of the nubs may vary. However, preferably, all nubs are between ¼" and ½" long with the short nubs having a length of from ¼" to ⅜" and the tall nubs having a length of from ⅜" to ½". Nubs shorter than ¼" have been found to have little or no effect while nubs longer that ½" have a tendency to fold over thereby reducing their effectiveness as well as the stimulation effect obtained by the use of alternating short and tall nubs.

The rollers 7, 11 and 12 are individually positioned and held in the frame 1 by the spindles 9 of each roller which fit into opposing slots or grooves 6 in the side rails 2 and 3. In the first embodiment of the device shown in FIG. 1, side rails 2 and 3 are provided with elongated slots 6 which are perpendicular to the longitudinal axis of the side rails 2 and 3. The slots 6 are about ½ to 1 inch in length and are bisected by the longitudinal axis of the rails 2 and 3.

As shown in FIG. 2, the spindles 9 are mounted on the ends of each roller at the center line thereof. At least one spindle 9 of each roller has a spring 19 biasing the spindle 9 outward while allowing the spindle 9 to be pushed inward. This biasing action allows the rollers 7, 11 and 12 to be installed in and removed from the frame 1, the spring loaded spindle being depressed so as to pass by the rail in order to enter or exit the slot 6.

Figure 5:
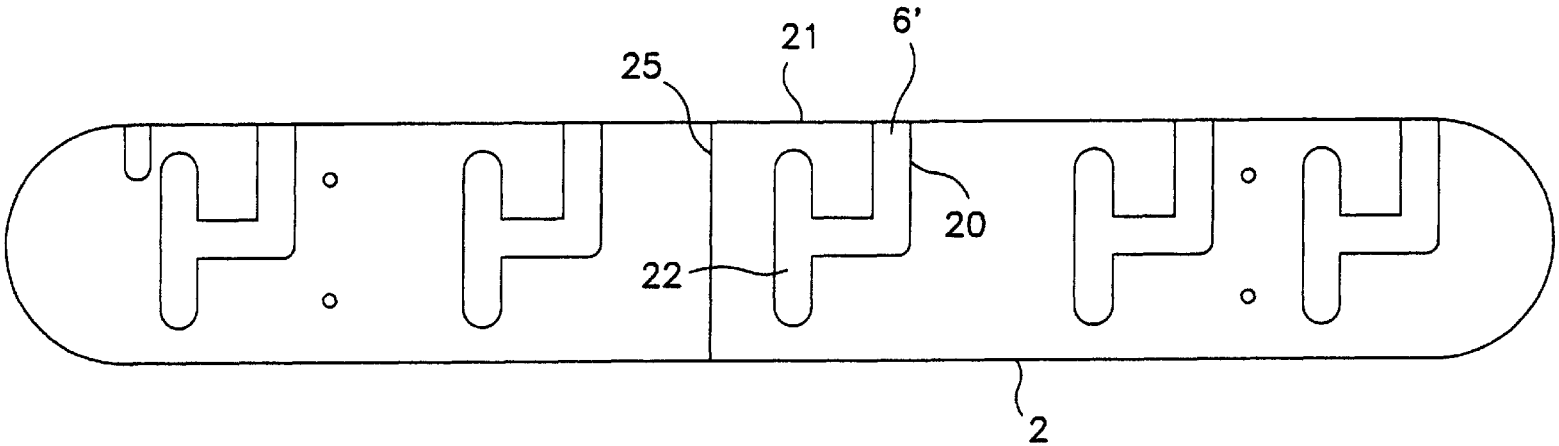
FIG. 5 is a view of the inner surface of one side rail of the device showing an alternative roller capture groove.

In an alternative embodiment shown in FIG. 5., rails 2 and 3 are provided with capture grooves 6' milled on the inner face of each rail. Capture grooves 6' comprise an L-shaped groove 20 extending downward from the upper surface 21 of the side rail with the horizontal portion of the L-shaped groove 20 being located along the longitudinal axis of the rail. A blind groove 22 is milled perpendicular to and connecting with the horizontal portion of the L-shaped groove 20. When the frame 1 is assembled, corresponding pairs of capture grooves 6' in each rail are positioned to receive the spindles 9 of rollers 7, 11 and 12 which may, but need not, be spring biased. The spindles 9 are inserted into capture grooves 6' from the upper surface 21 of the rails 2 and 3 such that the spindles 9 pass downward and horizontally through the L-shaped groove 20 into blind groove 22, which, being closed at each end allows the frame 1 to drop downward relative to the rollers such that the spindles 9 are retained within the upper portion of blind grooves 22. Both slots 6 and capture grooves 6' are spaced equidistantly along rails 2 and 3 with the spacing sufficient to permit free rotation of adjacent rollers regardless of the location of either intervertebral extension roller 11 or combined intervertebral extension and accupressure stimulation roller 12. The rollers 7, 11 and 12 are thereby free to rotate within the frame 1 and the plurality of rollers 7, 11 and 12 are retained in a parallel spaced relationship during use as shown in FIG. 1.

Figure 6:
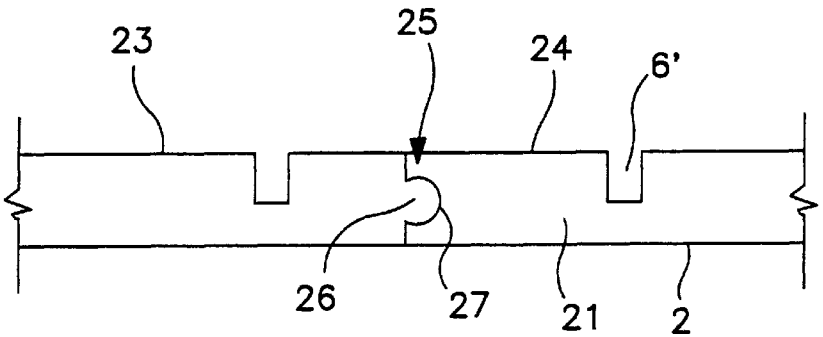
FIG. 6 is a view of the top of one side rail showing a connection means.

To facilitate packing and storage when not in use without resorting to complete disassembly, frame 1 may be modified so as to be separable into two sections. This modification is shown in FIG. 6 and comprises providing each rail 2 and 3 in two sections 23 and 24 each of which is preferably one half the total length of the frame 1. The mating end of each section 23 and 24 has a cooperating connection means 25 such as a dovetail or similar joint in which a male element 26 is vertically slidable into a female element 27, these elements having cooperating flanges and undercuts to prevent horizontal separation of the sections.

The manner in which the device functions is three-fold: 1) simple roller massage, 2) mobilization of the vertebral column through intervertebral extension, and 3) stimulation of paravertebral accupressure points. The removable rollers provide for multiple options for support of the vertebral column during use of the device. Where simple roller massage is desired, the frame 1 is completely populated with massage rollers 7. For massage and intervertebral extension, one of the massage rollers 7 is removed and the intervertebral extension roller 11 is installed in its place. The spacing of the slots 6 or capture grooves 6' permits the intervertebral extension roller to be installed in any location within the frame. Similarly, when paravertebral accupressure stimulation is desired, the combined intervertebral extension and accupressure stimulation roller 12 is installed at the desired location within the frame 1.

The device is used by placing it against a planar surface, generally the floor. The user then lays back on the device thereby being supported by the rollers. If the intervertebral extension roller 11 or the combined intervertebral extension and accupressure stimulation roller 12 is used, it is positioned within the frame at a location corresponding to the area of the user's back to be so treated. To provide the massaging action, the user simply moves back and forth over the device which causes it to roll relative to the planar surface and the user's back. This rolling action also allows the user to mobilize or treat multiple vertebral segments, i.e. cervical, thoracic, lumbar, sacral, without dismounting or repositioning either the rollers or himself.

To appreciate the manner in which the invention can provide massage intervertebral extension of the spine a basic review of the intervertebral articulations is needed. As with all articulations of the musculoskeletal system, there is a significant amount of motion permitted between all of the articulating components of the vertebral column. These components feature highly specialized connective tissues including bone, cartilage, ligaments, and the connective tissue framework of the intervertebral disc. The zygapophyseal joints, intervertebral disc, and surrounding connective tissues work together forming a functional unit that allows for intersegmental motion.

Generally, motion between any two adjacent vertebrae is extremely limited and consists of a small amount of gliding at the zygapophyseal joints and rotation around the longitudinal axis of the vertebral bodies. One vertebra can move in relation to an adjacent vertebra in six different directions along and around three different axes. It is the compound effect of these small amounts of gliding and rotation at multiple functional units that provides for a range of motion of the vertebral column as a whole. The motion of the vertebral column as a whole is similar to that of a joint with three degrees of freedom permitting flexion and extension, lateral flexion, and rotation.

The functional spinal unit is the smallest segment of the spine that contains all of the components of the complete spine and demonstrates the characteristics of the complete spine. The functional unit of the spine consists of two vertebrae, the zygapophyseal joints, intervertebral discs, and associated soft tissue structures including muscles, ligaments, joint capsules, nerves and vessels. The concept of the functional spinal unit is important because it illustrates the interdependence of the articulations.

The functional spinal unit also functions in load bearing that is primarily produced by body weight, muscle contraction, and gravity. During movement of the vertebral column, forces are distributed and redistributed and as a result the loads are shared by all of the components of the functional spinal unit. Compressions and shear are two loads to which the elements of the functional spinal unit are subjected.

Intervertebral discs are designed to attenuate shock and transmit a wide array of forces. The intervertebral discs which make up about 20–33% of the length of the vertebral column increase in size from the cervical to the lumbar region. Disc thickness varies from approximately 3 mm in the cervical region to approximately 9 mm in the lumbar region. While the discs are largest in the lumbar region and smallest in the cervical region, the ratio between disc thickness and vertebral body height is greatest in the cervical and lumbar regions and least in the thoracic region. The greater this ratio, the greater the mobility. Therefore, the cervical and lumbar regions have greater mobility than the thoracic region. During extension of the vertebral column the more rostral vertebra tilts and glides posteriorly over the caudal vertebra. As extension takes place there is compression of the posterior part of the disc while the anterior part of the disc is stretched. Along with the zygapophyseal joints, the intervertebral disc receives the total compressive force of the spine.

The zygapophyseal joints are synovial joints formed by articulation between the inferior articular process of one vertebra and the superior articular process of the subjacent vertebra. Resistance to movement at these joints is provided by the capsular arrangement, orientation of the joint surfaces and supporting soft tissues as ligaments and muscles. From these factors various combinations of motion between adjacent vertebrae can be inferred. It is orientation of the zygapophyseal joint surfaces, which varies from region to region, that determines the direction of the motion. The amount of extension between adjacent vertebra is greater in the cervical and lumbar regions than in the thoracic region.

The significance of the interdependence of the articulations as it contributes to spinal motion is evident throughout the vertebral column. For example, the orientation of the zygapophyseal joint surfaces at the L4–L5 lumbar vertebrae are oriented in such a manner as to allow motion in the sagittal plane (flexion/extension) but limit motion in the coronal and frontal planes. There are approximately 20–25° of sagittal movement between the L4 and L5 vertebrae and the same amount between the L5 and S1 vertebrae. This results in the last two mobile segments of the vertebral column accounting for nearly 40–50° of sagittal plane motion.

As the spine is extended in the upright position, weight bearing by the zygapophyseal joints is increased. Instead of the compressive force being primarily distributed to the anteriorly located vertebral body—intervertebral disc interface, the posteriorly placed zygapophyseal joints and laminae are subjected to increased compressive load. With the subject positioned supine on the device, these vertical loads produced primarily by body weight, muscle contraction and gravity are greatly reduced and the zygapophyseal joints are, in effect, unloaded. This unloading of the zygapophyseal joints occurs because in the supine position the muscles supporting the upright spine are relaxed, no longer exerting force on the vertebral column, and the effect of gravity on the longitudinal axis of the vertebral has been eliminated.

Relaxation of the paravertebral musculature is further enhanced by the support provided by the additional massage rollers 7 which may be positioned both rostral and caudal to the intervertebral extension roller 11. The massage rollers 7 also provide bilateral support of the trunk and pelvis. The massage rollers 7 are readily removable and may be easily repositioned to either provide additional support or less support as the subject feels is needed. In addition, the soft texture of the intervertebral extension roller 11 contributes to the subject's comfort.

With the subject in the supine position, the offset feature of the larger, intervertebral extension roller 11 provides a passive external force which causes intervertebral or intersegmental extension. This occurs because the roller 11 is positioned under an individual vertebra in such a manner as to provide support to the vertebra and allow segmental extension and posterior glide of the vertebra located immediately rostral. The result is passive extension of the vertebral column. Whenever the larger diameter intervertebral extension roller 11 is used, the weight of the trunk is more concentrated over that roller which results in an increased force to the area in contact with the roller 12.

Accupressure is the stimulation of acupuncture points through the application of pressure to those points. Accupressure has been used through the ages to soothe muscular pain, temporarily increase blood circulation to the treated area, reduce muscular tension and provide a general feeling of well being. Accupressure is non-invasive, acts only on the skin, and may be applied by the fingers, triggers, needle beds, balls, bars, rollers. In this present invention, the accupressure is applied by nubs that affixed to the offset roller.

The combined intervertebral extension and accupressure stimulation roller 12 with nubs 14 is used to provide accupressure stimulation to multiple paravertebral acupuncture points. As with the intervertebral extension roller 11, the larger diameter of the combined roller 12 provides for increased force by concentrating the weight of the trunk to the surface of the roller 12 while the nubs 14 also decrease the surface area through which the weight of the trunk will be distributed, therefore further increasing the density of the force. In this manner pressure is applied to paravertebral acupuncture points as the subject glides the trunk back and forth over the nubs 14. The central region of the roller 12 is devoid of nubs 14 to prevent irritation of the spinous processes of the vertebrae as the subjects glides the trunk back and forth over the roller 12.

In Chinese medicine acupuncture points are distributed throughout the body along channels of meridians. The specific acupuncture points that are stimulated by the present invention are located along the urinary bladder meridian which is located bilaterally over the paravertebral musculature extending from the lower cervical region to the sacrum and continuing into the lower extremities to the lateral aspect of the fifth toe. In traditional Chinese medicine, stimulation of acupuncture points along the urinary bladder meridian is indicated in treating such ailments as low back pain, sciatica, and the pain associated with strain/spasm of the paravertebral musculature and stress.

The device also has utility in providing general massage of the back. This is accomplished with the subject positioned supine with his feet on the support surface and hips and knees flexed. In this position, the subject alternately extends and flexes the knees to glide the trunk back and forth over the rollers 7 in a gentle rhythmic manner. The larger rollers 11 and 12 as well as the smaller massage rollers 7 may be readily moved to any position on the frame 1 as desired to vary the location of the massage.

The configuration of the device also lends itself for use in supporting the lumbar spine during exercise routines. With the subject supine, the larger roller may be positioned under the lumbar spine for support and maintenance of the lumbar lordosis during various abdominal and lower extremity strengthening or range of motion exercises. Another unique feature of the device is that any of the rollers may be easily removed from the frame for singular use in exercise routines and the like.

The frame 1 is of a length to provide simultaneous support of the upper thoracic and the sacral areas of the body. Support of the thoracic and sacral areas is maintained during intervertebral extension while using the larger rollers 11 and 12. In addition, the frame 1 allows the user to vary the amount of support as well as the areas of support. The amount and areas of support are varied by increasing or decreasing the number of massage rollers 7 mounted in the frame 1 as well as their location. The structure and arrangement of roller grooves in the frame rails facilitates this variable positioning of the rollers and is such that a wide range of support options are possible.

The rollers themselves have unique characteristics which contribute to the overall utility of the device. The size of the larger rollers 11 and 12 provides for intervertebral extension while the smaller adjacent massage rollers 7 concurrently provide support for the vertebrae located both rostral and caudal to the vertebrae being placed in extension. In addition, the massage rollers 7 provide bilateral support for the trunk and pelvis, thus distributing the user's weight laterally along the posterior aspect of the body. This increase in the area of weight support contributes to the comfort of the user by not focusing the weight on the sensitive bony spinous processes or the area immediately adjacent the spine. Further, the soft texture of the massage rollers 7 contributes to the user's comfort and the overall relaxing function of the device. For maximal intervertebral extension to occur, the muscles supporting the vertebral column must be in a state of relaxation. The soft texture also encourages the user to remain on the device for a longer period of time. The larger rollers 11 and 12 have a firmer texture than the massage rollers 7 and provide a foundation for the accupressure nubs 14. In order to avoid undue pressure on the sensitive spinous processes, the combined intervertebral extension and accupressure stimulation roller 12 is provided with a circumferential channel or groove 13 midway along its length. The accupressure nubs 14 are mounted on either side of this groove 13. The firm foundation of the large roller is necessary to assure that maximal force is available for accupressure stimulation to the accupressure points. In addition, the groove 13 allows segmental load bearing to take place on the laminae of the vertebrae, rather than on the spinous processes. This in turn allows the body weight and gravity to account for a posterior gliding of the vertebra immediately rostral to the supported vertebra at the zygapophyseal joints.

The foregoing description presents the preferred embodiments of the present invention and it is understood that many variations and modifications of those embodiments will be evident to those skilled in the art and may be carried out without departing from the spirit and scope of the present invention.

What is claimed is:

1. A combination back massage and accupressure stimulation apparatus comprising a rectangular frame and a plurality of rollers receivable within said frame and freely rotatable therein, said rollers having a diameter greater than a height dimension of said frame whereby said rollers extend above and below said frame to support a user lying supine thereon and whereby said frame includes means to maintain said plurality of rollers in a spaced, parallel and freely rotatable operating arrangement, said means further allowing said rollers to be readily interchangeable, said rollers comprising a plurality of identical massage rollers each having a constant diameter and comprising a rigid core and an outer resilient surface, said rollers having spindles at each end cooperating with said means to maintain said rollers in said frame and to permit rotation therein, at least one roller having a diameter greater than said massage rollers and having spindles at each end cooperating with said means in said frame whereby said at least one roller is freely interchangeable in said frame with any one of said massage rollers, said at least one roller further comprising first and second constant diameter sections separated by a central region of reduced diameter and an arrangement of rubbery nubs circumferentially disposed about each of said first and second sections substantially adjacent to said region of reduced diameter, wherein said nubs are part of a plurality of molded bands or strips having an inner surface corresponding to the outer surface of said at least one roller and an outer surface with said nubs molded thereon, whereby said at least one roller is capable of receiving said molded bands or strips on said constant diameter sections, said means to maintain said rollers in spaced parallel freely rotatable operating arrangement comprises a plurality of opposing pairs of matched grooves in said frame, each pair of grooves being adapted to removably receive spindles on the ends of each of said rollers whereby said rollers are removable and interchangeable within said frame, and wherein said matched grooves are milled into inner faces of parallel rails of said frame and each comprise a first groove extending vertically from an upper edge of said rails to a longitudinal midpoint thereof, a second groove extending horizontally from said first groove and bisecting a third groove parallel to said first groove and having closed ends, whereby a spindle of a roller is inserted into said first groove and passes from said first groove into said second groove and thence into said third groove where it is captured within one of said closed ends, thereby retaining said roller within said frame.

2. The apparatus of claim 1 wherein said molded bands or strips comprise at least one elastic sleeve having said nubs molded therein, said sleeve being slidable onto and off of said roller.

3. The apparatus of claim 2 further comprising means to secure said at least one sleeve to said roller whereby displacement of said at least one sleeve is prevented.

4. The apparatus of claim 1 wherein said molded bands or strips comprise a plurality of molded strips having inner and outer surfaces corresponding to a portion of the outer circumferential surface of said roller and having said nubs molded on said outer surface thereof and a roller engaging means molded on the inner surface thereof, said roller having means capable of receiving said roller engaging means.

5. A combination back massager and accupressure stimulation apparatus comprising, a) a rectangular frame comprising first and second elongated rails joined in parallel and spaced relationship by first and second cross bars defining an area capable of receiving and retaining a plurality of rollers therein, and b) a plurality of rollers receivable within said frame, said rollers each comprising a cylindrical roller body having centrally located spindles on each end thereof, wherein said rails are provided with means to removably receive said spindles whereby said rollers are receivable within said frame in a spaced parallel arrangement and are freely rotatable and interchangeable within said frame, said rollers having a cylindrical diameter greater than the height of said frame whereby said rollers extend diametrically above and below said frame when said apparatus is in use, said rollers further comprising, a) a plurality of identical massage rollers each having a constant cylindrical diameter and comprising a rigid core and an outer, resilient surface, and b) at least one roller of larger cylindrical diameter and comprising a rigid core and an outer resilient surface, whereby said at least one roller is interchangeable in said frame with any of said massage rollers, wherein said at least one roller comprises first and second sections of constant diameter separated by a central region of reduced diameter and wherein said first and second sections are provided with an irregular accupressure stimulation surface adjacent to said central region of reduced diameter, and wherein said irregular accupressure stimulation surface comprises a plurality of molded bands or strips having inner surfaces corresponding to at least a portion of the outer circumferential surface of said at least one roller and having an outer surface with a plurality of raised nubs molded thereon, said inner surface further having roller engaging means, whereby said roller is capable of receiving said molded members, and wherein said means to removably receive said spindles comprises a plurality of opposing matched grooves milled into inner faces of said rails, each comprising a first groove extending vertically from an upper edge of said rails to a longitudinal midpoint thereof, a second groove extending horizontally from said first groove and bisecting a third groove parallel to said first groove and having closed ends, whereby a spindle of a roller is inserted into said first groove and passes from said first groove into said second groove and thence into said third groove where it is captured within one of said closed ends, thereby retaining said roller within said frame.

6. The apparatus of claim 1 wherein said plurality of raised nubs are in a pattern on said first and second sections.

7. The apparatus of claim 1 wherein said molded bands or strips comprise at least one sleeve of material having a degree of elasticity sufficient to permit stretching to fit over said roller, said sleeve having said raised nubs molded onto its outer surface.

8. The apparatus of claim 5 wherein said molded bands or strips comprise a plurality of molded strips having an inner surface corresponding to a portion of the outer circumferential surface of said roller and an outer surface having said nubs molded thereon and a roller engaging means molded on said inner surface, said roller having means capable of receiving said roller engaging means.

* * * * *

UNITED STATES PATENT AND TRADEMARK OFFICE

CERTIFICATE OF CORRECTION

PATENT NO. : 6,419,650 B1 
DATED : July 16, 2002
INVENTOR(S) : James P. Ryan, John P. Cummings and John M. O'Connor It is certified that error appears in the above-identified patent and that said Letters Patent is hereby corrected as shown below:

Title page,
Item [76] Inventors: should read
-- James P. Ryan, Cazenovia, NY 13035
John P. Cummings, Rochester, MN
John M. O'Connor, Clay, NY 13041 --
Item [73] Assignee: should read: -- Fitness Works INC., 61 Albany St., Cazenovia, NY --

Signed and Sealed this

Twentieth Day of May, 2003

JAMES E. ROGAN
*Director of the United States Patent and Trademark Office*